US006808119B2

(12) United States Patent
Lee et al.

(10) Patent No.: US 6,808,119 B2
(45) Date of Patent: Oct. 26, 2004

(54) HEAT PUMP AIR CONDITIONING SYSTEM COMPRISING ADDITIONAL HEATER AND METHOD FOR OPERATING THE SAME

(75) Inventors: Won Hee Lee, Seoul-si (KR); Chang Min Choi, Seoul-si (KR); Yoon Jei Hwang, Seoul (KR); Deok Huh, Buchun-si (KR); Cheol Min Kim, Kwangmyung-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/378,826

(22) Filed: Mar. 5, 2003

(65) Prior Publication Data

US 2004/0011064 A1 Jan. 22, 2004

(30) Foreign Application Priority Data

Jul. 22, 2002 (KR) ..... 10-2002-0042906

(51) Int. Cl.[7] ..... G05D 23/00

(52) U.S. Cl. ..... 237/2 B; 62/238.7

(58) Field of Search ..... 237/2 A, 2 B; 62/238.7, 238.1, 238.2, 238.3, 238.4, 238.5, 238.6

(56) References Cited

U.S. PATENT DOCUMENTS 4,323,109 A * 4/1982 Jaster ..... 165/45
4,627,483 A * 12/1986 Harshbarger et al. ..... 237/2 A
4,796,437 A * 1/1989 James ..... 62/79
5,367,601 A * 11/1994 Hannabery ..... 392/307
5,465,588 A * 11/1995 McCahill et al. ..... 62/127

* cited by examiner

*Primary Examiner*—Derek S. Boles
(74) *Attorney, Agent, or Firm*—Greenblum & Bernstein, P.L.C.

(57) ABSTRACT

Disclosed are a heat pump air conditioning system comprising an additional heater and a method for operating the same, in which the additional heater is driven during a full activation standby time taken to simultaneously operate all of a plurality of compressors so as to rapidly satisfy an increased heating load. When the increased heating load exceeding a total capacity of some compressors selected from the plural compressors is sensed, since the additional heater is driven during the full activation standby time so as to rapidly satisfy the increased heating load, the air conditioning system improves heating effectiveness and uniformly maintains room temperature, thereby improving users' comfort.

4 Claims, 4 Drawing Sheets

HEAT PUMP AIR CONDITIONING SYSTEM COMPRISING ADDITIONAL HEATER AND METHOD FOR OPERATING THE SAME

BACKGROUND OF THE INVENTION

1. Field of the Invention

The present invention relates to a heat pump air conditioning system comprising an additional heater and a method for operating the same, and more particularly to an air conditioning system comprising an additional heater driven during a standby time taken to simultaneously operate all of a plurality of compressors so as to rapidly satisfy an increased heating load, and a method for operating the air conditioning system.

2. Description of the Related Art

Hereinafter, a conventional air conditioning system comprising an additional heater and a method for operating the system will be described with reference to FIGS. 1 and 2.

FIG. 1 is a block diagram illustrating a heating cycle of a general air conditioning system, and FIG. 2 is a flow chart illustrating a method for operating a conventional air conditioning system comprising an additional heater.

A recent air conditioner having cooling and heating functions comprises a compressor, a condenser, an expansion valve, and an evaporator. A thermal cycle is formed by a refrigerant passing through the compressor, the condenser, the expansion valve, and the evaporator. Herein, the thermal cycle is divided into a cooling cycle for discharging cold air in a cooling mode and a heating cycle for discharging warm air in a heating mode by converting a flow direction of the refrigerant. Thereby, the air conditioner serves to condition air of a room. The aforementioned air conditioner having cooling and heating functions is referred to as a heat pump air conditioner.

Such a heat pump air conditioner uses a four-way valve for selecting the flow direction of the refrigerant installed in a conventional cooling apparatus, thereby reversing functions of components of the cooling apparatus so as to convert the cooling cycle into the heating cycle in which warm air is discharged from an indoor, unit and cold air is discharged from an outdoor unit.

The conventional air conditioning system is operated in the heating mode via the heating cycle as shown in FIG. 1, as follows.

A plurality of compressors 10 for converting a refrigerant from a low-temperature and low-pressure state into a high-temperature and high-pressure state includes a first compressor 11 and a second compressor 12. The first and second compressors 11 and 12 are simultaneously operated, or the first compressor 11 is operated and the second compressor 12 is stopped, thereby variably changing the compression capacity of the refrigerant.

The four-way valve 20 transmits the refrigerant discharged from the plural compressors 10 to an outdoor heat exchanger 50 in the cooling mode and to an indoor heat exchanger 30 in the heating mode, thereby alternating the flow direction of the refrigerant.

The indoor heat exchanger 30 serves as condensing means for condensing the gaseous refrigerant in the high-temperature and high-pressure state into a liquid refrigerant. An indoor unit 39 comprises the indoor heat exchanger 30, and an indoor blower (not shown) installed next to the indoor heat exchanger 30 so as to discharge warm or cold air to the interior of a room. The indoor blower includes a motor 31 and an indoor fan 32.

The expansion valve 40 expands the liquid refrigerant condensed by the condensing means into a two-phase refrigerant of solid and liquid phases in a low-temperature and low-pressure state.

The outdoor heat exchanger 50 serves as evaporating means for converting the two-phase refrigerant into a gaseous refrigerant by absorbing external heat. An outdoor unit 99 comprises the outdoor heat exchanger 50, and an outdoor blower (not shown) installed next to the outdoor heat exchanger 50 so as to discharge air to the outdoor heat exchanger 50 and increase heat exchange efficiency. The outdoor blower includes an outdoor fan (not shown) and a motor (not shown).

Thereby, a heating cycle consisting of compression, condensation, expansion, and evaporation is formed.

When the above-described air conditioning system is operated in the heating mode, in order to effectively heat a room, the heat exchange between the outdoor heat exchanger 50 and external cold air contacting the outdoor heat exchanger 50 must be effectively achieved. A temperature difference between the external air and the refrigerant passing through the outdoor heat exchanger 50 is very low. Therefore, other heating means such as a stove, a boiler, a heater, etc. are additionally used to heat the interior of the room in a cold area, thereby causing a heavy economic burden to customers.

Further, when the external cold air contacts the outdoor heat exchanger 50, frost forms on the surface of the outdoor heat exchanger 50, the interior of which has a comparatively high temperature, thereby hindering the circulation of the refrigerant and reducing the efficiency of the compressor. Therefore, the conventional air conditioner having an insufficient heating function is limitedly used in summer time, thereby causing an inconvenience to users.

With reference to FIG. 2, the method for operating the aforementioned conventional air conditioner is described as follows.

At the early stage of operation, a plurality of the compressors are simultaneously operated so as to have a compression capacity of the refrigerant of 100%. (S1)

A control unit (not shown) for entirely controlling the air conditioner system senses the variation of a heating load within a room, and then judges whether the heading load is increased or not. (S2)

When the heating load is increased, all of the plural compressors are simultaneously operated so that the compression capacity of the refrigerant is 100%, and when the heating load is decreased, the first compressor is continuously operated but the second compressor is stopped so that the compression capacity of the refrigerant is 40% via the heating cycle. (S3)

In case room temperature is lowered according to the operation of only the first compressor or a user sets a higher desirable room temperature, the heating load is increased. Then, the control unit judges whether the heating load is increased or not. (S4)

When the heating load is not increased, only the first compressor is continuously operated. On the other hand, when the heating load is increased, the control unit outputs a signal for re-operating the stopped second compressor to the second compressor, and simultaneously judges whether a standby time for re-operating the stopped compressor has passed or not. (S5) Hereinafter, the signal is referred to as a full activation signal, and the standby time is referred to as a full activation standby time.

The full activation standby time denotes a time taken from the beginning of the re-operation of the stopped second compressor to the complete re-operation of the stopped second compressor in order to simultaneously operate all of the plural compressors so that the compression capacity of the refrigerant becomes 100%.

Therefore, during the full activation standby time, the control unit continuously maintains the operation of the first compressor so that the compression capacity of the refrigerant is 40%. (S6) After a lapse of the full activation standby time, the control unit operates all of the plural compressors simultaneously so that the compression capacity of the refrigerant is 100%.

However, since the above-described conventional air conditioner does not satisfy the increased heating load during the full activation standby time, the room temperature is rapidly lowered, thereby causing discomfort and inconvenience to users.

SUMMARY OF THE INVENTION

Therefore, the present invention has been made in view of the above problems, and it is an object of the present invention to provide a heat pump air conditioning system comprising an additional heater and a method for operating the same, in which the additional heater is automatically driven without a user's manual manipulation during a full activation standby time taken to simultaneously operate all of a plurality of compressors so as to rapidly satisfy an increased heating load, thereby providing convenience to users, and preventing the lowering of room temperature so as to improve users' comfort.

In accordance with one aspect of the present invention, the above and other objects can be accomplished by the provision of a heat pump air conditioning system with an additional heater, comprising:

an air conditioner for conditioning air of a room so as to satisfy a heating load by circulating a refrigerant via a heating cycle consisting of compression, condensation, expansion, and evaporation;

an additional heater installed within the air conditioner and driven so as to rapidly satisfy the heating load; and a control unit for controlling a compression capacity of the refrigerant according to the heating load and controlling an operation of the additional heater.

In accordance with another aspect of the present invention, there is provided a method for operating a heat pump air conditioning system with an additional heater, comprising:

the first step of selectively operating a plurality of compressors;

the second step of sensing an increase of a heating load exceeding a total capacity of the compressors selectively operated in the first step;

the third step of inputting a full activation order into the system for instructing all of the plural compressors to operate, and simultaneously the additional heater to drive; and the fourth step of stopping the operation of the additional heater and simultaneously operating all of the plural compressors.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the annexed drawings.

Figure 1:
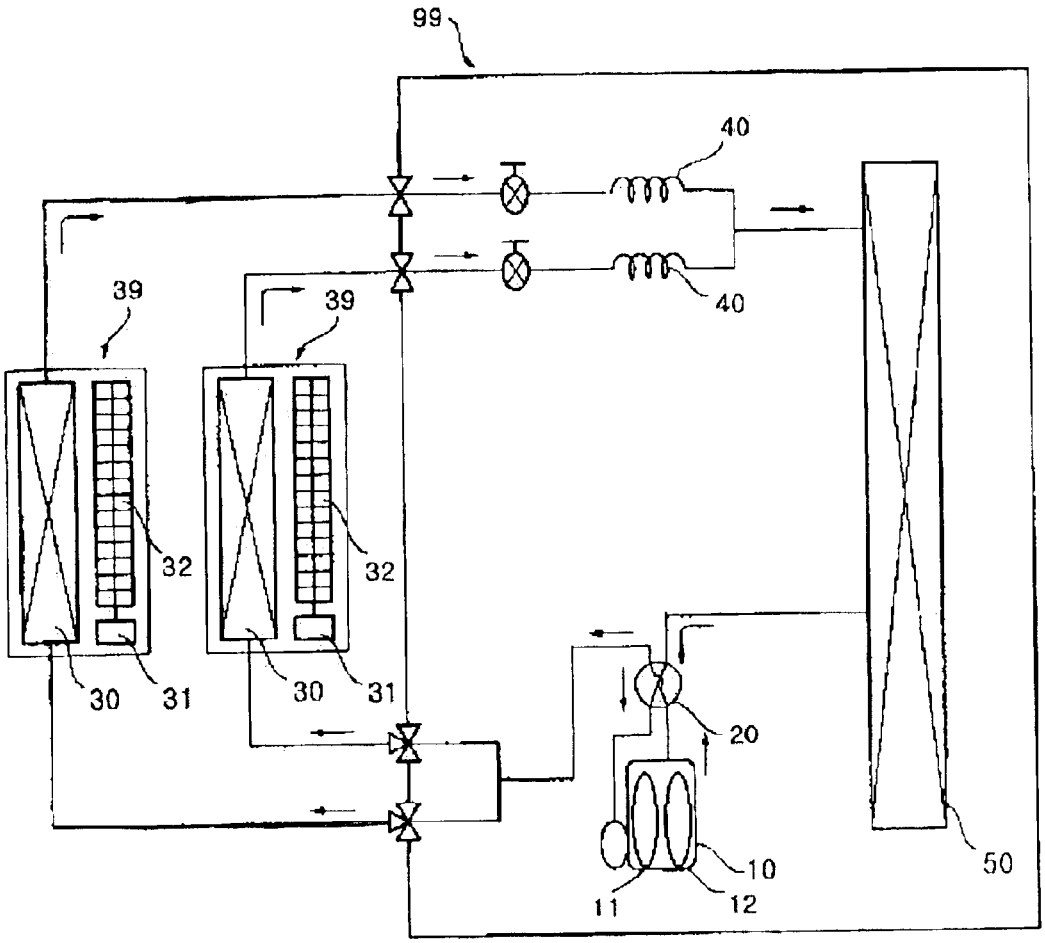
FIG. 1(Prior Art)
FIG. 1 is a block diagram illustrating a heating cycle of a conventional air conditioning system.
Figure 2:
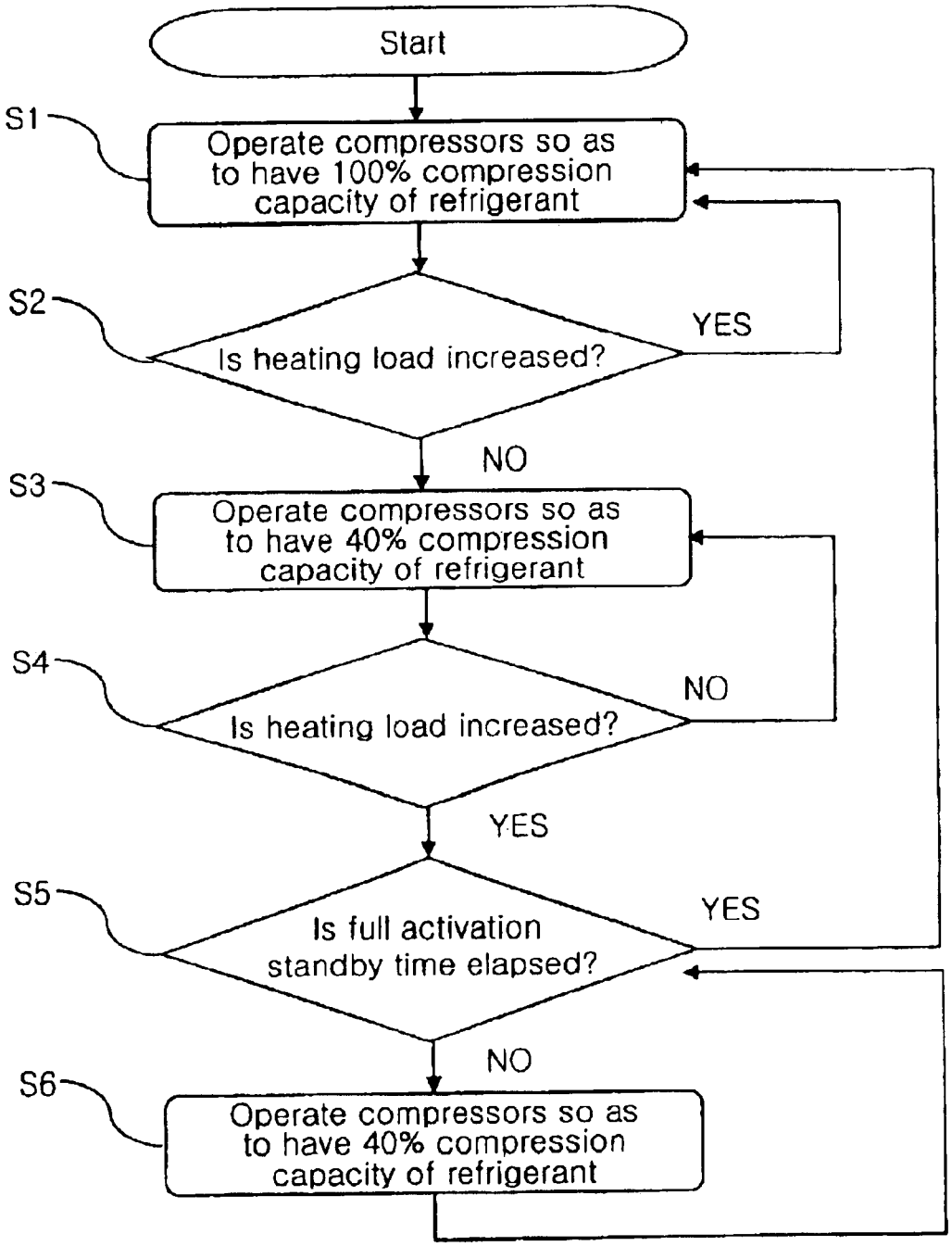
FIG. 2 (Prior Art)
FIG. 2 is a flow chart illustrating a method for operating a conventional air conditioning system comprising an additional heater.
Figure 3:
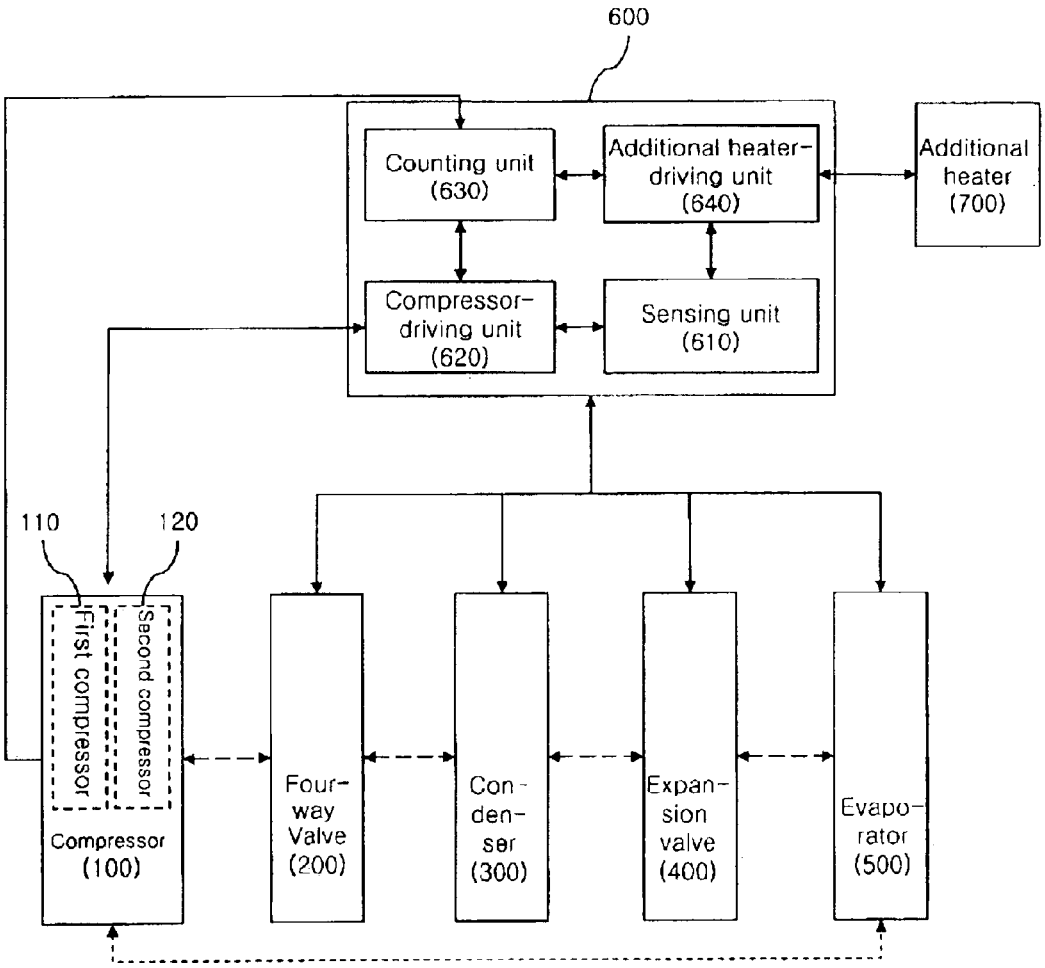
FIG. 3 is a block diagram of an air conditioning system comprising an additional heater in accordance with the present invention.

FIG. 3 is a block diagram of an air conditioning system comprising an additional heater in accordance with the present invention. A heating cycle of the air conditioning system of the present invention shown in FIG. 3 is similar to that of FIG. 1. However, the air conditioning system of the present invention comprises the additional heater for rapidly satisfying an increased heating load, and a control unit for entirely controlling the air conditioning system and controlling the operation of the additional heat. A solid arrow denotes a flow of a control signal from the control unit to each component, and a dotted arrow denotes a flow of a refrigerant between components of an air conditioner.

First, compressors 100 of the air conditioner suck a gaseous refrigerant evaporated by an evaporator, and then compress the sucked gaseous refrigerant so as to convert it into a high-pressure state. Therefore, kinetic energy of molecules within the gaseous refrigerant is increased, thereby causing collisions between the molecules. Then, energy generated by the collisions between the molecules rises the temperature of the gaseous refrigerant so that the gaseous refrigerant is converted into a high-temperature and high-pressure state. Since the above gaseous refrigerant has the increased number of the molecules per unit volume, the gaseous refrigerant is easily liquefied at room temperature.

The compressors 100 of the air conditioner include a first compressor 110 and a second compressor 120. Each of the first and second compressors 110 and 120 has a designated compression capacity of the refrigerant so as to compress a designated percentage of the total capacity (100%) of the refrigerant. Herein, the compression capacities of the refrigerant of the first and second compressors 110 and 120 are set by a manufacturer. In accordance with a preferred embodiment of the present invention, the first compressor 110 has a 40% compression capacity of the refrigerant, and the second compressor 120 has a 60% compression capacity of the refrigerant. However, the compression capacity of each compressor is not limited thereto.

The gaseous refrigerant in the high-temperature and high-pressure state, discharged from the compressors 100, is induced into an indoor heat exchanger by a four-way valve 200. A condenser 300 is used as the indoor heat exchanger. The condenser 300 removes heat from the gaseous refrigerant in the high-temperature and high-pressure state, thereby liquefying the gaseous refrigerant, i.e., condensing the gaseous refrigerant so as to convert it into a liquid refrigerant in a mid-temperature and high-pressure state, and discharging air having a heat capacity corresponding to latent heat generated by the above condensation of the refrigerant. Thus, the room is heated.

An expansion valve 400 expands the liquid refrigerant in the mid-temperature and high-pressure state, thereby reducing the pressure of the liquid refrigerant. Then, the liquid refrigerant is converted into a low-temperature and low-pressure state, and the converted liquid refrigerant is supplied to an evaporator 500.

The evaporator 500 is used as an outdoor heat exchanger. Herein, the liquid refrigerant in the low-temperature and low-pressure state supplied from the expansion valve 400 absorbs heat necessary for evaporation from external air, thereby being converted into a gaseous refrigerant. Then, the gaseous refrigerant is re-sucked into the compressor 100, and then compressed so as to be re-converted into a high-temperature and high-pressure refrigerant.

An additional heater 700 is installed in the air conditioner, and driven during a full activation standby time taken to simultaneously operate the plural compressors 100 according to the increase of a heating load. That is, when the heating load is increased in case the first compressor 110 is operated, in order to satisfy the increased heating load, a control unit 600 of the air conditioner outputs a control signal for additionally re-operating the stopped second compressor 120. Generally, after pressures at an inlet and an outlet of the first compressor 110 are equalized, the compressor 100 compresses the refrigerant. Hereinafter, a time taken to equalize the pressures at the inlet and the outlet of the compressor is referred to as a full activation standby time.

During the full activation standby time of the stopped second compressor 120, the additional heater 700 is driven together with the operation of the first compressor 110 having the 40% compression capacity of the refrigerant. Thereby, the increased heating load is more rapidly satisfied by heat emitted from the additional heater 700.

The control unit 600 for controlling the components 100 to 500 of the air conditioner and the additional heater 700 modulates the four-way valve 200 so as to control a circulation direction of the refrigerant according to the cooling and heating modes, thereby forming a cooling cycle in the cooling mode and forming a heating cycle in the heating mode. Further, the control unit 600 controls the compression capacity of the refrigerant so as to selectively or simultaneously operate a plurality of the compressors 100 according to cooling and heating loads, and controls the turning-on/off of the additional heater 700 so as to rapidly satisfy the increased heating load.

The control unit 600 includes a sensing unit 610, a compressor-driving unit 620, a measuring unit 630, and an additional heater-driving unit 640. The sensing unit 610 senses whether the heating load is increased or not. The compressor-driving unit 620 selectively or simultaneously operates a plurality of the compressors 100 according to the increase of the heating load sensed by the sensing unit 610, thereby variably controlling the compression capacity of the refrigerant. The measuring unit 630 measures the full activation standby time taken to simultaneously operate a plurality of the compressors 100. The additional heater-driving unit 640 drives the additional heater 700 during the full activation standby time measured by the measuring unit 630.

The sensing unit 610 compares a difference between a desirable temperature and a real room temperature to a reference value. When the temperature difference exceeds the reference value, the sensing unit 610 senses the increase of the heating load, and then outputs a control signal for ordering the compressor-driving unit 610 to simultaneously operate all of the plural compressors 100.

The measuring unit 630 measures the full activation standby time from a moment when the full activation order is inputted to the measuring unit 630. Since the full activation standby time taken to equalize pressures at the inlets and the outlets of the compressors 100 has different values according to types of employed compressors, the full activation standby time is predetermined by a manufacturer.

Therefore, at a moment when the full activation order is inputted to the measuring unit 630, the measuring unit 630 informs the additional heater-driving unit 640 of the order so that the additional heater 700 is turned on. Then, the measuring unit 630 measures time, and then turns off the additional heater 700 at a moment when the operations of all of the plural compressors are completed.

The additional heater-driving unit 640 controls the additional heater 700, so that the additional heater 700 is driven during the full activation standby time, and then damped after the lapse of the full activation standby time. Then, the additional heater 700 is stopped, and all of the plural compressors 100 are simultaneously operated so that the compression capacity of the refrigerant is 100% and the refrigerant is circulated via the heating cycle.

Figure 4:
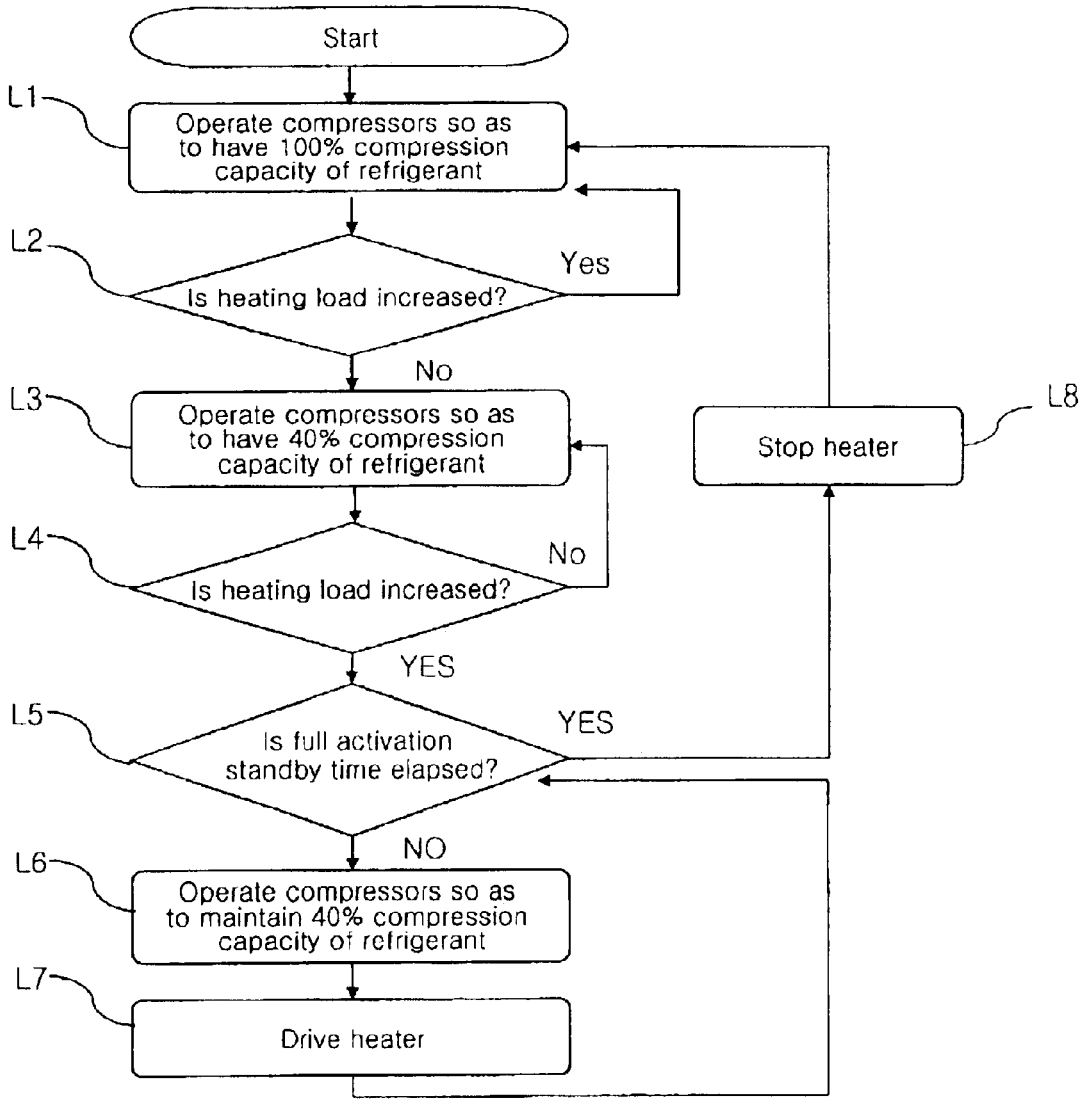
FIG. 4 is a flow chart illustrating a method for operating the air conditioning system comprising an additional heater in accordance with the present invention.

FIG. 4 is a flow chart illustrating a method for operating the air conditioning system comprising an additional heater in accordance with the present invention. An air conditioner of the air conditioning system of the present invention employs two compressors. The first compressor has the 40% compression capacity of the refrigerant, and the second compressor has the 60% compression capacity of the refrigerant. However, the compression capacity of each compressor is not limited thereto, but may be variably predetermined by a manufacturer.

When a desirable room temperature and a heating order are simultaneously inputted into the air conditioning system, in order to remove a difference between the desirable room temperature and a real room temperature, all of the plural compressors including the first and second compressors are simultaneously operated so that the compression capacity of the refrigerant is 100%. Thereby, the air conditioning system of the present invention discharges warm air via the heating cycle. (L1)

In case the real room temperature is lowered or a higher desirable room temperature is set by a user, a difference between the real room temperature and the desirable room temperature is increased and thus the heating load is increased. On the other hand, when the room temperature reaches the desirable room temperature via the circulation of the refrigerant compressed by the simultaneously operated compressors, a difference between the room temperature and the desirable temperature is reduced and thus the heating load is also decreased.

Therefore, the control unit, which is installed in the air conditioner so as to entirely control the air conditioning system, judges whether the heating load is increased or not, thereby variably controlling the operation state of the compressors according to the variation of the heating load. (L2)

In order to judge whether the heating load is increased or not a difference between the desirable room temperature and is the real room temperature is obtained, and the obtained difference is compared to a reference value. When the obtained difference exceeds the reference value, the increase of the heating load is detected.

When the heating load is increased, all of the plural compressors are simultaneously operated. However, when the heating load is not increased, the first compressor is continuously operated but the second compressor is stopped so that the compressors 100 have the 40% compression capacity of the refrigerant and the refrigerant is circulated via the heating cycle. (L3) Herein, a case of simultaneously operating all of the plural compressors is referred to as a full activation, and a case of operating only parts selected from the plural compressors is referred to as a selective activation.

While only the first compressor is operated so that the refrigerant having the 40% compression capacity is circulated via the heating cycle, if the room temperature is lowered or a higher desirable temperature is set by a user, the heating load is increased.

Therefore, the control unit judges whether the heating load is increased. (L4) When the heading load is not increased, only the first compressor is continuously operated. On the other hand, when the heating load is increased, a full activation order is transmitted to the plural compressors so that the second compressor is additionally operated together with the first compressor.

The full activation standby time denotes a time taken from the beginning of the re-operation of the stopped second compressor to the complete re-operation of the stopped second compressor so as to simultaneously operate all of the plural compressors. The full activation standby time is predetermined by a manufacturer according to types of the compressors employed by the air conditioner, and the predetermined full activation standby time is inputted to the control unit of the air conditioner. The full activation standby time is measured by the measuring unit from a moment when the full activation order is outputted from the control unit.

The measuring unit judges whether the full activation standby time is elapsed or not. (L5) During the full activation standby time, the first compressor is continuously operated so that the compression capacity of the refrigerant is 40%. (L6) At this time, since the increased heating load cannot be rapidly satisfied by the 40% compression capacity of the refrigerant, the additional heater is driven. (L7) Herein, when the full activation order for additionally operating the second compressor is inputted to the air conditioning system, the additional heater is driven regardless of the increased degree of the heating load.

After the lapse of the full activation standby time, that is, when the second compressor is completely operated so that all of the plural compressors are simultaneously operated, the additional heater is stopped. (L8) Herein, the refrigerant with a 100% compression capacity is circulated via the heating cycle.

As apparent from the above description, the present invention provides a heat pump air conditioning system comprising an additional heater and a method for operating the same, in which the additional heater is driven during a full activation standby time taken to simultaneously operate all of a plurality of compressors so as to rapidly satisfy an increased heating load, and then the additional heater is stopped after a lapse of the full activation standby time so as to rapidly and variably satisfy the variation of the heating load, thereby preventing the lowering of room temperature, giving comfort to users, and improving heating capacity and effectiveness of the air conditioning system.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat pump air conditioning system with a heater, comprising:

an air conditioner that conditions air of a room so as to satisfy a heating load via a heating cycle formed by a refrigerant passing through a compressor, a condenser, an expansion valve and an evaporator;

a heater installed within the air conditioner and driven so as to rapidly satisfy the heating load; and a control unit that controls a compression capacity of the refrigerant according to the heating load and that controls an operation of the heater;

wherein the air conditioner includes:

a plurality of compressors that compress a gaseous refrigerant in a low-temperature and low-pressure state so as to convert it into a high-temperature and high-pressure state;

a condenser that condenses the gaseous refrigerant in the high-temperature and high-pressure state so as to convert it into a liquid refrigerant in a mid-temperature and high-pressure state;

an expansion valve that decompresses the liquid refrigerant in the mid-temperature and high-pressure state so as to convert it into a low-temperature and low-pressure state; and an evaporator that evaporates the liquid refrigerant in the low-temperature and low-pressure state so as to convert it into a gaseous refrigerant in a low-temperature and low-pressure state; and the control unit includes:

a sensing unit that senses whether the heating load is increased;

a compressor-driving unit that one of selectively and simultaneously operates a plurality of the compressors according to the increased heating load so as to variably control the compression capacity of the refrigerant;

a measuring unit that measures a full activation standby time taken to simultaneously operate a plurality of the compressors; and a heater-driving unit that drives the heater during the full activation standby time measured by the measuring unit.

2. The heat pump air conditioning system with a heater as set forth in claim 1, wherein the sensing unit judges whether a difference between a desirable room temperature and an actual room temperature exceeds a reference value, and detects the increase of the heating load when the temperature difference exceeds the reference value.

3. The heat pump air conditioning system with a heater as set forth in claim 1, wherein the heater-driving unit damps the additional heater after a lapse of the full activation standby time.

4. A method for operating a heat pump air conditioning system with a heater, comprising:

selectively operating a plurality of compressors;

sensing an increase of a heating load corresponding to a total required compression capacity that exceeds a total compression capacity of the selectively operated compressors;

inputting a full activation order for instructing all of the plural compressors to operate, and simultaneously the heater to operate; and stopping the operation of the heater and simultaneously operating all of the plural compressors;

wherein the heater is driven during a full activation standby time taken to simultaneously operate all of the plural compressors.

* * * * *